US010995706B1

(12) United States Patent
Tan et al.

(10) Patent No.: US 10,995,706 B1
(45) Date of Patent: May 4, 2021

(54) GAS MIXING DEVICE AND A NATURAL GAS ENGINE

(71) Applicant: Weichai Power Co., Ltd., Shandong (CN)

(72) Inventors: Xuguang Tan, Shandong (CN); Dehui Tong, Shandong (CN); Zhen Liu, Shandong (CN)

(73) Assignee: Weichai Power Co., Ltd., Shandong (CN)

( * ) Notice: Subject to any disclaimer, the term of this patent is extended or adjusted under 35 U.S.C. 154(b) by 0 days.

(21) Appl. No.: 17/003,537

(22) Filed: Aug. 26, 2020

Related U.S. Application Data

(63) Continuation of application No. PCT/CN2019/130586, filed on Dec. 31, 2019.

(30) Foreign Application Priority Data

Nov. 22, 2019 (CN) ..... 201911152738.9

(51) Int. Cl.
*F02B 47/08* (2006.01)
*F02M 26/47* (2016.01)
*F02M 26/00* (2016.01)

(52) U.S. Cl.
CPC ..... *F02M 26/47* (2016.02); *F02M 2026/004* (2016.02)

(58) Field of Classification Search
CPC ..... F02M 26/47; F02M 26/17; F02M 26/19; F02M 2026/004

(Continued)

(56) References Cited

U.S. PATENT DOCUMENTS 6,880,535 B2 * 4/2005 Sorter et al. ..... F02B 43/00 123/528
9,074,540 B2 * 7/2015 Subramanian ..... F02D 41/0077 123/568.17

(Continued)

FOREIGN PATENT DOCUMENTS

CN 105673266 A 6/2016
CN 109707541 A 5/2019
WO 2017/068297 A1 4/2017

OTHER PUBLICATIONS

First Office Action dated Jan. 10, 2020 received in Japanese Patent Application No. CN 201911152738.9 together with an English language translation.

*Primary Examiner* — Hai H Huynh
(74) *Attorney, Agent, or Firm* — Scully Scott Murphy & Presser

(57) ABSTRACT

The present disclosure belongs to the technical field of engines, and specifically relates to a gas mixing device and a natural gas engine. The gas mixing device includes a housing, a first mixing core, a first measurement assembly, a second mixing core, and a second measurement assembly. An air inlet and a combustion gas inlet respectively communicate with the first mixing core to form a mixed gas in the first mixing core; the first measurement assembly is connected to the first mixing core, the second mixing core is connected in the housing, the EGR exhaust gas inlet and the first mixing core respectively communicate with the second mixing core, and the second measurement assembly is connected to the EGR exhaust gas inlet. In the gas mixing device according to the embodiment of the present disclosure, the first measurement assembly and the second measurement assembly respectively provide measurement data for obtaining flow rates of the air, combustion gas and EGR exhaust gas. As compared with the speed-density method (Continued)

and the throttle model, the results tend to be more accurate, which facilitates a control of the air-fuel ratio to improve the conversion efficiency of the three-way catalytic converter.

10 Claims, 4 Drawing Sheets

(58) Field of Classification Search
USPC ..... 123/527, 568.17
See application file for complete search history.

(56) References Cited

U.S. PATENT DOCUMENTS

| | | | | |
|---|---|---|---|---|
| 9,309,837 | B2 * | 4/2016 | Ulrey et al. ..... | F02M 25/07 123/568.17 |
| 10,316,803 | B2 * | 6/2019 | Hampson et al. ..... | F02M 26/19 123/568.17 |
| 10,634,099 | B2 * | 4/2020 | Hampson et al. ..... | F02M 26/19 123/568.17 |
| 2015/0101580 | A1 | 4/2015 | Sorge | |
| 2015/0369126 | A1 * | 12/2015 | Knopfel et al. ..... | F02C 3/34 |

* cited by examiner

GAS MIXING DEVICE AND A NATURAL GAS ENGINE

TECHNICAL FIELD

The present disclosure belongs to the technical field of engines, and specifically relates to a gas mixing device and a natural gas engine.

BACKGROUND

This section provides only background information related to the present disclosure, and therefore is not necessarily the prior art.

The National VI natural gas engine adopts a technical route of equivalent combustion, exhaust gas re-circulation (EGR) and three-way catalytic converter. The three-way catalytic converter refers to an external purification device installed in an automobile exhaust system, which can convert harmful gases such as carbon monoxide, hydrocarbons and nitrogen oxides discharged from the exhaust gas into harmless carbon dioxide, water and nitrogen through oxidation and reduction.

Since three types of harmful emissions need to be treated at the same time, the catalytic efficiency will be relatively high only when the content of the three gases in the exhaust gas after combustion in the automobile is within a certain range, and the air-fuel ratio of the automobile therefore needs to be controlled. If the air-fuel ratio is not controlled accurately, a conversion efficiency of the three-way catalytic converter will be reduced, and the emission will deteriorate. An accurate control of the air-fuel ratio requires an accurate measurement of air flow. The traditional air flow measurement methods are mainly speed-density method and throttle model. In the speed-density method, an intake air flow of the engine is measured based on engine speed, cylinder displacement, intake manifold pressure and temperature, and engine charging efficiency, wherein the charging efficiency is obtained through calibration under steady-state operating conditions, and the measurement of flow under transient operating conditions is not accurate. By taking advantage of a throttling characteristic of air by a throttle valve, the throttle model measures the air flow according to the throttle valve's own flow characteristic curve, the temperature and pressure before the throttle valve and the pressure after the throttle valve. The throttle valve exerts a throttling effect on the air. When a ratio of pressures after and before the throttle valve is 95% or more, that is, in a non-throttle region operating condition, the fluid flowing through the throttle valve has a non-linear relationship with a ratio of pressures after and before the throttle valve. In this case, the measurement of flow is also inaccurate.

SUMMARY

An object of the present disclosure is to at least solve the problem of low conversion efficiency of the three-way catalytic converter caused by inaccurate measurement of gas flow under transient operating conditions in the related art. This object is achieved through the following technical solutions.

In a first aspect of the present disclosure, a gas mixing device is provided, which includes a housing, a first mixing core, a first measurement assembly, a second mixing core, and a second measurement assembly, wherein the housing is provided with an air inlet, a combustion gas inlet, and an EGR exhaust gas inlet; the first mixing core is connected in the housing, and the air inlet and the combustion gas inlet respectively communicate with the first mixing core to form a mixed gas in the first mixing core; the first measurement assembly is connected to the first mixing core, and the first measurement assembly is configured to obtain a first flow rate of the mixed gas and provide measurement data; the second mixing core is connected in the housing, and the EGR exhaust gas inlet and the first mixing core respectively communicate with the second mixing core; the second measurement assembly is connected to the EGR exhaust gas inlet, and the second measurement assembly is configured to obtain a second flow rate of the EGR exhaust gas and provide measurement data.

In the gas mixing device according to an embodiment of the present disclosure, when the engine is running, in addition to the combustion of air and combustion gas, the EGR technology is also introduced to make the EGR exhaust gas continue to participate in the combustion process to reduce the generation of NOx. The air and combustion gas enter the first mixing core through the air inlet and the combustion gas inlet respectively and are fully mixed in the first mixing core. The first measurement assembly measures relevant data of a mixed gas of the air and combustion gas after being mixed to obtain a first flow rate. At the same time, the EGR exhaust gas enters the second mixing core through the EGR exhaust gas inlet. The second measurement assembly measures relevant data of the EGR exhaust gas to obtain a second flow rate. The EGR exhaust gas is mixed with the mixed air and combustion gas again, and the three gases, after completion of mixing, enter an engine manifold for combustion. After the combustion is completed, they enter the three-way catalytic converter for conversion. Through the first measurement assembly and the second measurement assembly, accurate transient measurements of the relevant data of the first flow rate and the second flow rate can be achieved. By adjusting the relevant data to adjust the first flow rate and the second flow rate, an accurate control of the air-fuel ratio can be achieved, the conversion efficiency of the three-way catalytic converter can be improved, the content of precious metals in the three-way catalytic converter can be reduced, the same conversion can also be completed, and the cost is reduced.

In addition, the gas mixing device according to an embodiment of the present disclosure may also have the following additional technical features.

In some embodiments of the present disclosure, the gas mixing device further includes a throat body connected in the housing;

the throat body is disposed between the first mixing core and the second mixing core, and a diameter of the throat body gradually decreases along a flow direction of gas to change gas pressures of the mixed gas and the EGR exhaust gas.

In some embodiments of the present disclosure, the throat body includes:

a depressurization section, wherein the depressurization section is connected in the housing, and a diameter of the depressurization section gradually decreases along the flow direction of the gas; and a first smooth section, wherein the first smooth section is connected to the depressurization section, and a diameter of the first smooth section is equal everywhere.

In some embodiments of the present disclosure, the first measurement assembly includes:

a first-temperature measurement member, which is connected to the housing and which is configured to measure a first temperature of the mixed gas; and a first-pressure measurement member, which is connected to the housing and which is configured to measure a first pressure of the mixed gas;

the gas mixing device further includes a second-pressure measurement member, which is connected to the first smooth section and which is configured to measure a second pressure of the mixed gas after passing through the depressurization section.

In some embodiments of the present disclosure, the second mixing core includes a guide section, and a first passage is formed between the guide section and the first smooth section;

wherein a diameter of the guide section is larger than the diameter of the first smooth section, and the diameter of the guide section gradually decreases along the flow direction of the gas.

In some embodiments of the present disclosure, the second measurement assembly includes:

a second-temperature measurement member, which is connected to the EGR exhaust gas inlet and which is configured to measure a second temperature of the EGR exhaust gas; and a third-pressure measurement member, which is connected to the EGR exhaust gas inlet and which is configured to measure a third pressure of the EGR exhaust gas;

the second-pressure measurement member is further configured to measure a fourth pressure of the EGR exhaust gas after entering the first smooth section.

In some embodiments of the present disclosure, the second mixing core further includes:

a second smooth section, wherein the second smooth section is connected to the guide section, and a diameter of the second smooth section is equal everywhere; and a diffuser section, wherein the diffuser section is connected to the second smooth section, and a diameter of the diffuser section gradually increases along the flow direction of the gas.

In some embodiments of the present disclosure, a second passage is formed between the first mixing core and the housing, the second passage is in communication with the combustion gas inlet, and the first mixing core is provided with a first injection port.

In some embodiments of the present disclosure, the gas mixing device further includes an injection pipe;

the injection pipe is connected in the first mixing core, and the injection pipe is provided with a second injection port.

A second aspect of the present disclosure also provides a natural gas engine, which includes the gas mixing device in any of the above technical solutions.

The engine of the embodiment of the present disclosure has the same advantages as the gas mixing device in any of the above technical solutions, which will not be repeated herein.

BRIEF DESCRIPTION OF THE DRAWINGS

Upon reading a detailed description of the preferred embodiments below, various other advantages and benefits will become clear to those skilled in the art. The drawings are only for the purpose of illustrating the preferred embodiments, and should not be considered as limiting the present disclosure. Moreover, identical parts are denoted by identical reference signs throughout the drawings.

FIG. 2 is a schematic view of an internal structure of the gas mixing device shown in

FIG. 1;

REFERENCE SIGNS

Figure 1:
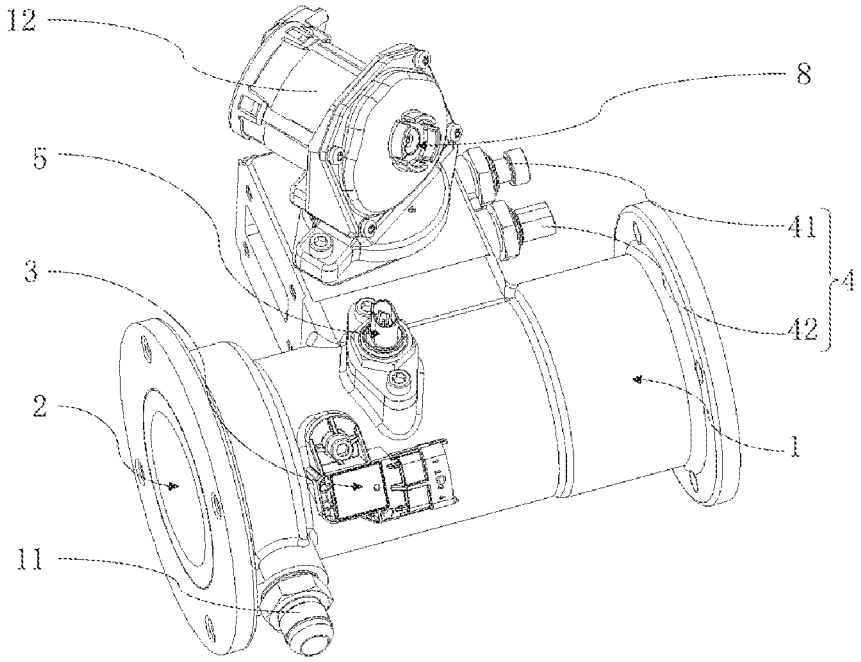
FIG. 1 is a schematic view of a three-dimensional structure of a gas mixing device according to an embodiment of the present disclosure.

1: housing; 11: combustion gas inlet; 12: EGR exhaust gas inlet;
2: first mixing core; 21: first passage; 22: first injection port; 23: injection pipe; 231: second injection port:
3: first measurement assembly;
4: second measurement assembly; 41: second-temperature measurement member; 42: third-pressure measurement member;
5: second-pressure measurement member;
6: second mixing core; 61: guide section; 62: second smooth section; 63: diffuser section;
7: throat body; 71: depressurization section; 72: first smooth section; 73: second passage;
8: EGR exhaust gas control valve.

DETAILED DESCRIPTION

Hereinafter, exemplary embodiments of the present disclosure will be described in more detail with reference to the accompanying drawings. Although the exemplary embodiments of the present disclosure are shown in the drawings, it should be understood that the present disclosure can be implemented in various forms and should not be limited by the embodiments set forth herein. Rather, these embodiments are provided to enable a more thorough understanding of the present disclosure and to fully convey the scope of the present disclosure to those skilled in the art.

It should be understood that the terms used herein are only for the purpose of describing specific exemplary embodiments, and are not intended to be limiting. Unless clearly indicated otherwise in the context, the singular forms "a", "an" and "said" as used herein may also mean that the plural forms are included. The terms "include", "including", "contain" and "have" are inclusive, and therefore indicate the existence of the stated features, steps, operations, elements and/or components, but do not exclude the existence or addition of one or more other features, steps, operations, elements, components and/or combinations thereof.

Although the terms "first", "second", "third", etc. may be used herein to describe a plurality of elements, components, regions, layers and/or sections, these elements, components, regions, layers and/or sections should not be limited by these terms. These terms may only be used to distinguish one element, component, region, layer or section from another region, layer or section. Unless clearly indicated otherwise in the context, terms such as "first", "second" and other numerical terms when used herein do not imply an order or sequence. Therefore, the first element, component, region, layer or section discussed below may be referred to as a second element, component, region, layer or section without departing from the teachings of the exemplary embodiments.

For ease of description, the terms of spatial relative relationship may be used herein to describe the relationship of one element or feature relative to another element or feature as shown in the drawings. These terms of relative relationship are, for example, "inner", "outer", "inside", "outside", "below", "under", "over", "above", etc. These terms of spatial relative relationship are intended to include different orientations of the device in use or in operation in addition to the orientation depicted in the drawings. For example, if the device in the figure is inverted, then an element described as "under another element or feature" or "below another element or feature" will then be oriented as "above another element or feature" or "over another element or feature". Therefore, the exemplary term "below" may include orientations of both "above" and "below". The device may be otherwise oriented (rotated by 90 degrees or in other directions) and the descriptors of spatial relative relationship used herein are explained accordingly.

Figure 2:
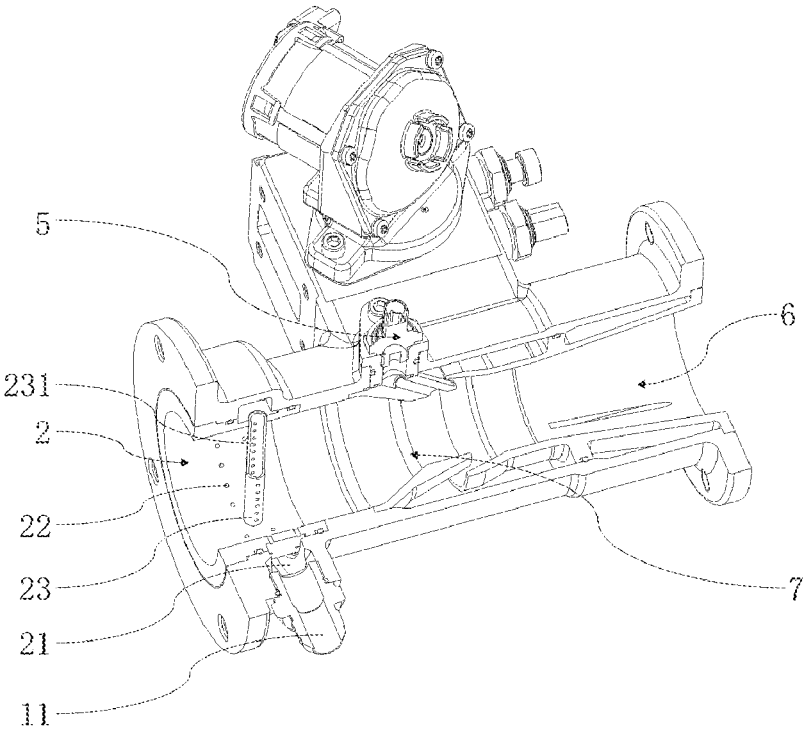
Figure 3:
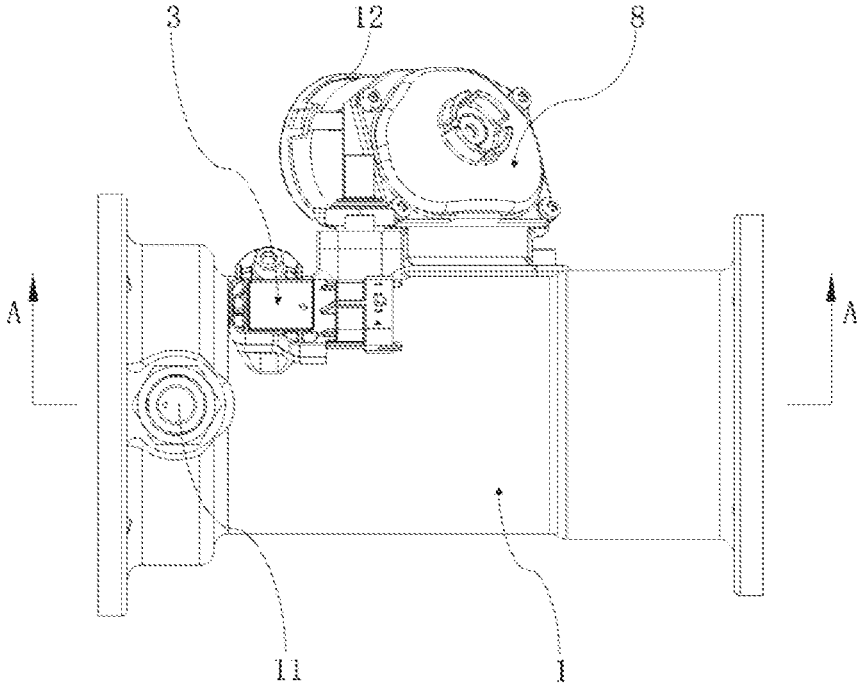
FIG. 3 is a front view of the gas mixing device shown in FIG. 1.
Figure 4:
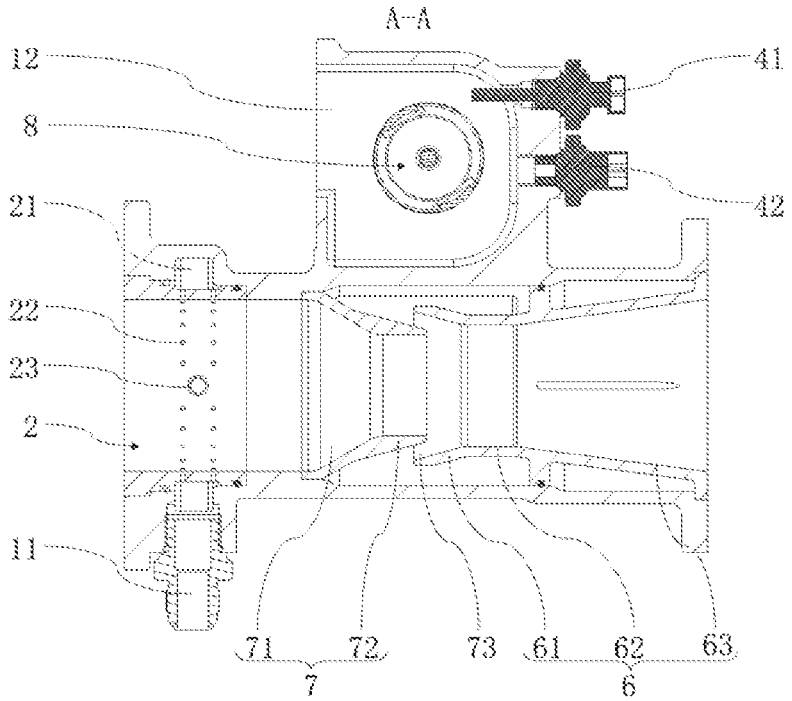
FIG. 4 is a schematic cross-sectional view taken along direction A-A shown in FIG. 3.
Figure 5:
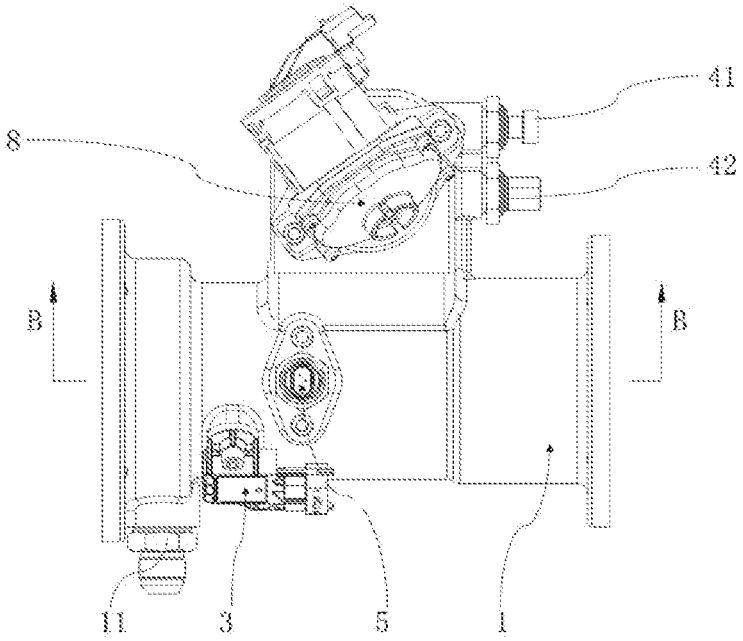
FIG. 5 is a top view of the gas mixing device shown in FIG. 1.
Figure 6:
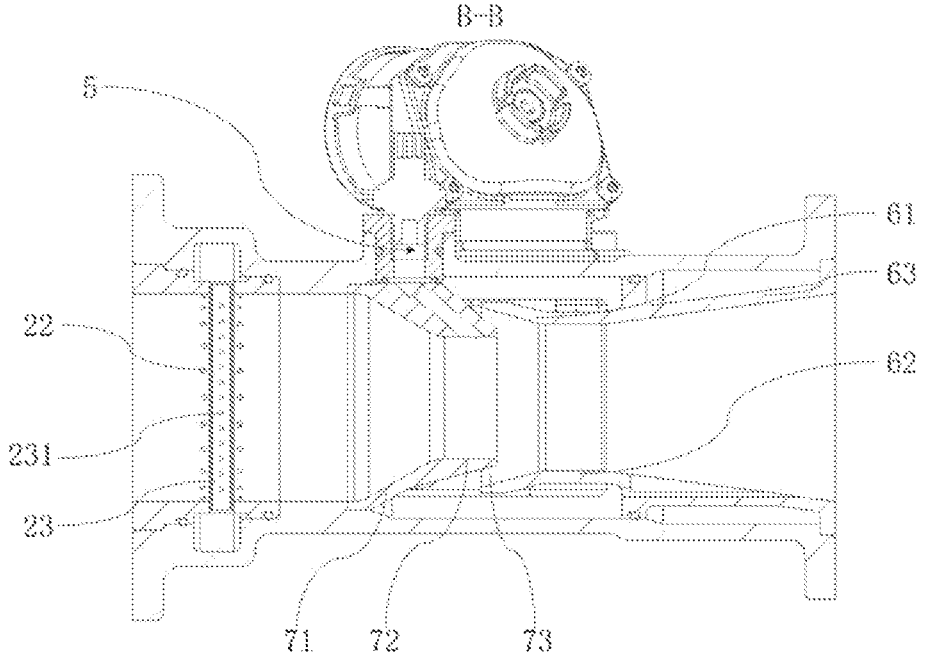
FIG. 6 is a schematic cross-sectional view taken along direction B-B shown in FIG. 5.

As shown in FIGS. 1 to 6, an embodiment of the present disclosure provides a gas mixing device, which includes a housing 1, a first mixing core 2, a first measurement assembly 3, a second mixing core 6 and a second measurement assembly 4. The housing 1 is provided with an air inlet, a combustion gas inlet 11 and an EGR exhaust gas inlet 12. The first mixing core 2 is connected in the housing 1, and the air inlet and the combustion gas inlet 11 respectively communicate with the first mixing core 2 to form a mixed gas in the first mixing core 2. The first measurement assembly 3 is connected to the first mixing core 2, and the first measurement assembly 3 is configured to obtain a first flow rate of the mixed gas to provide measurement data. The second mixing core 6 is connected in the housing 1, and the EGR exhaust gas inlet 12 and the first mixing core 2 respectively communicate with the second mixing core 6. The second measurement assembly 4 is connected to the EGR exhaust gas inlet 12, and the second measurement assembly 4 is configured to obtain a second flow rate of EGR exhaust gas and provide measurement data.

In the gas mixing device according to the embodiment of the present disclosure, the housing 1 serves as a base for installation of the combustion gas inlet 11, the EGR exhaust gas inlet 12, the first mixing core 2, the second mixing core 6, the first measurement assembly 3, and the second measurement assembly 4. When the engine is running, in addition to the combustion of air and combustion gas, the EGR technology is also introduced to make the EGR exhaust gas continue to participate in the combustion process to reduce the generation of NOx. The air and combustion gas enter the first mixing core 2 through the air inlet and the combustion gas inlet 11 respectively and are fully mixed in the first mixing core 2. The first measurement assembly 3 measures relevant data of a mixed gas of the air and combustion gas after being mixed to obtain a first flow rate. At the same time, the EGR exhaust gas enters the second mixing core 6 through the EGR exhaust gas inlet 12. The second measurement assembly 4 measures relevant data of the EGR exhaust gas to obtain a second flow rate. The EGR exhaust gas is mixed with the mixed air and combustion gas again, and the three gases, after completion of mixing, enter an intake manifold for combustion. After the combustion is completed, they enter the three-way catalytic converter for conversion. Through the first measurement assembly 3 and the second measurement assembly 4, accurate transient measurements and steady-state measurements of the relevant data of the first flow rate and the second flow rate can be achieved, which replaces a differential pressure flowmeter. In addition, by adjusting the relevant data to adjust the first flow rate and the second flow rate, an accurate control of the air-fuel ratio can be achieved, the conversion efficiency of the three-way catalytic converter can be improved, the content of precious metals in the three-way catalytic converter can be reduced, the same conversion can also be completed, and the cost is reduced.

The first mixing core 2 and the housing 1 are connected by interference fit, with a sealing ring disposed therebetween. The second mixing core 6 and the housing 1 are connected by interference fit, with a sealing ring disposed therebetween. A sealing ring is disposed between the first measurement assembly 3 and the housing 1, and a sealing ring is disposed between the second measurement assembly 4 and the housing 1, thereby avoiding gas leakage. The combustion gas inlet 11 and the housing 1 are threadingly connected, with a sealing ring disposed therebetween.

In some embodiments of the present disclosure, the gas mixing device further includes an EGR exhaust gas control valve 8 and a controller. The EGR exhaust gas control valve 8 is connected to the EGR exhaust gas inlet 12, and the controller can obtain relevant data of the first flow rate and the second flow rate and calculate the first flow rate and the second flow rate based on the relevant data. According to the conversion efficiency of the three-way catalytic converter, the first flow rate and the second flow rate need to be controlled within a certain range to achieve an accurate air-fuel ratio. The controller can adjust the second flow rate by using the EGR exhaust gas control valve 8 so that the second flow rate changes with the first flow rate to match the conversion efficiency requirements of the three-way catalytic converter. That is, the conversion efficiency of the three-way catalytic converter can be improved by changing the relevant data, which can reduce the content of precious metals in the three-way catalytic converter and greatly reduce the cost.

The controller is an electronic control unit (ECU), and the controller is electrically connected to the EGR exhaust gas control valve 8. The EGR exhaust gas control valve 8 may be a butterfly valve or a poppet valve, which is not limited herein.

In some embodiments of the present disclosure, the measurement of the first flow rate of the mixed gas formed by air and combustion gas under transient operating conditions in the related art is not accurate, and the actual first flow rate is related to the environment where the mixed gas is located, and is further related to the temperature and pressure difference of the environment. The relevant data is the temperature and pressure of the environment where the mixed gas is located, so a throat body 7 is provided in the housing 1, and the pressures of the mixed gas and the EGR exhaust gas are changed through the throat body 7 to make the measurement results more accurate. The throat body 7 is disposed between the first mixing core 2 and the second mixing core 6, and a diameter of the throat body 7 gradually decreases along the flow direction of the gas. When the gas passes through a position where the diameter decreases, the flow velocity of the gas increases, the pressure decreases, and the gas forms a pressure difference with a gas that has not passed through the position where the diameter decreases. The first flow rate of the gas may be calculated from the pressure difference.

In some embodiments of the present disclosure, the throat body 7 includes a depressurization section 71 and a first smooth section 72. The depressurization section 71 is configured to change the flow velocity of the gas passing through the depressurization section 71, that is, to change the pressure of the gas passing through the depressurization section 71, so that a pressure difference of the first flow rate is calculated under the transient operating conditions. When the gas pressure changes, in order to reduce the generation of gas turbulence, the throat body 7 further includes the first smooth section 72, so that the gas passing through the depressurization section 71 flows smoothly at the first smooth section 72, the pressure is stabilized, and gas instability is reduced.

The throat body 7 and the housing 1 are connected by interference fit, with a sealing ring disposed therebetween to avoid gas leakage and at the same time ensure the accuracy of pressure measurement.

In some embodiments of the present disclosure, the first measurement assembly 3 includes a first-temperature measurement member and a first-pressure measurement member, both of which are connected to the first mixing core 2. The first-temperature measurement member is configured to measure the first temperature of the mixed gas that has not entered the throat body 7, and the first-pressure measurement member is configured to measure the first pressure of the mixed gas that has not entered the throat body 7. In addition, it is required to measure the second pressure of the mixed gas after entering the depressurization section 71 of the throat body 7, so a second-pressure measurement member 5 is disposed on the first smooth section 72. Disposing the second-pressure measurement member 5 on the first smooth section 72 is because that the pressure at the first smooth section 72 has changed and tends to be stable, so that the accuracy of the measurement can be further improved. A pressure difference between the first pressure and the second pressure is obtained. According to the first temperature measured and the pressure difference, by using the formula $$q_m = \frac{C}{\sqrt{1-\beta^4}}\varepsilon\frac{\pi}{4}d^2\sqrt{2\Delta P\times\rho},$$

the first flow rate of the mixed gas can be calculated, wherein of is the flow rate, c is an outflow coefficient, β is a diameter ratio, ε is an expansion coefficient, Δp is the pressure difference, and ρ is the fluid density, and wherein each of the outflow coefficient, the fluid density and the like is related to the temperature of gas. By calculating the first flow rate according to the first temperature, first pressure, and second pressure measured in real time, the measurement of the first flow rate under transient operating conditions is realized. As compared with the speed-density method and the throttle model, the results tend to be more accurate, which facilitates a control of the air-fuel ratio to improve the conversion efficiency of the three-way catalytic converter.

In some embodiments of the present disclosure, in order to further improve the measurement accuracy of the second pressure measurement member 5, a measurement port is provided at a position close to a distal end of the first smooth section 72, and the measurement port communicates with the throat body 7.

The first temperature measurement member and the first pressure measurement member are respectively a temperature sensor and a pressure sensor, and an integrated temperature and pressure sensor may also be used. In an embodiment, a temperature and pressure sensor is used.

In some embodiments of the present disclosure, the second mixing core 6 includes a guide section 61, a first passage 21 is formed between the guide section 61 and the first smooth section 72, and the EGR exhaust gas enters the first passage 21 through the EGR exhaust gas inlet 12. A diameter of the guide section 61 is larger than the diameter of the first smooth section 72, that is, the pressure at the first smooth section 72 is lower than the pressure at the guide section 61, so a negative pressure zone is formed at the throat body 7. The pressure difference forces the EGR exhaust gas to enter the first smooth section 72 again. When the back pressure of the exhaust gas remains unchanged, a higher EGR rate can be achieved, thereby lowering the exhaust temperature and a tendency of knocking, and reducing the amount of nitrogen oxides generated, which can help to reduce the content of precious metals in the three-way catalytic converter. A thermal load of the components will be reduced after the exhaust temperature is lowered, which improves the reliability. When the EGR rate is maintained unchanged, the back pressure of the exhaust gas can be reduced, a pumping loss can be reduced, and the engine efficiency can be improved, thereby reducing a consumption rate of the combustion gas and improving economy.

The first passage 21 is an annular passage. The EGR exhaust gas enters the first passage 21 through the EGR exhaust gas inlet 12 and the EGR exhaust gas control valve 8 and enters the first passage 21 from different directions simultaneously.

In some embodiments of the present disclosure, the diameter of the guide section 61 gradually decreases along the flow direction of the gas. At the first passage 21, the mixed gas formed by air and combustion gas is mixed with EGR again, and as the diameter decreases, the flow velocity decreases and the gas pressure increases, so that the three gases are evenly mixed here.

In some embodiments of the present disclosure, in order to calculate the second flow rate of the EGR exhaust gas under transient operating conditions, it is also necessary to measure the temperature and pressure difference of the environment where the EGR exhaust gas is located. The relevant data is the temperature and pressure of the environment where the EGR exhaust gas is located. The second measurement assembly 4 includes a second-temperature measurement member 41 and a third-pressure measurement member 42, both of which are connected to the EGR exhaust gas inlet 12. The second-temperature measurement member 41 is configured to detect the second temperature of the EGR exhaust gas that has not passed through the EGR exhaust gas control valve 8, and the third-pressure measurement member 42 is configured to detect the third pressure of the EGR exhaust gas that has not passed through the EGR exhaust gas control valve 8. In addition, it is required to measure a fourth pressure of the EGR exhaust gas that has entered the first passage 21. The fourth pressure is measured by the second-pressure measurement member 5. A pressure difference between the fourth pressure and the third pressure is obtained. According to the second temperature measured and the pressure difference, by using the formula $$q_m = \frac{C}{\sqrt{1-\beta^4}}\varepsilon\frac{\pi}{4}d^2\sqrt{2\Delta P\times\rho},$$

the second flow rate of the EGR exhaust gas can be calculated, wherein of is the flow rate, c is an outflow coefficient, β is a diameter ratio, ε is an expansion coefficient, Δp is the pressure difference, and ρ is the fluid density, and wherein each of the outflow coefficient, the fluid density and the like is related to the temperature of gas. By calculating the second flow rate according to the second temperature, third pressure, and fourth pressure measured in real time, the measurement of the second flow rate under transient operating conditions is realized. As compared with the speed-density method and the throttle model, the results tend to be more accurate, which facilitates a control of the air-fuel ratio to improve the conversion efficiency of the three-way catalytic converter. The differential pressure flowmeter in the related art is eliminated, and the EGR control valve and the measurement members are integrated into the mixer, which reduces the volume of the engine's EGR system and intake system, making the engine have a more compact structure.

The measurement of the pressure of the mixed gas after passing through the throat body 7 and the measurement of the pressure of the EGR exhaust gas after entering the first passage 21 are implemented by the same one pressure measurement member, which reduces the cost.

In some embodiments of the present disclosure, in addition to the guide section 61, the second mixing core 6 also includes a second smooth section 62 and a diffuser section 63. When the gas pressure changes, in order to reduce the generation of gas turbulence, the second smooth section 62 enables the gas passing through the first passage 21 and the guide section 61 to flow smoothly here, stabilizes the pressure, and reduces gas instability. The guide section 61, the second smooth section 62 and the diffuser section 63 are connected in sequence, wherein the minimum diameter of the diffuser section 63, the diameter of the second smooth section 62 and the minimum diameter of the guide section 61 are equal. The diameter of the diffuser section 63 gradually increases along the flow direction of the gas, but the maximum diameter of the diffuser section 63 is larger than the maximum diameter of the guide section 61. When the gas that has passed through the second smooth section 62 enters the diffuser section 63, the flow velocity decreases and the pressure increases. In the related art, the equivalent combustion engine has a high exhaust temperature, and a high EGR rate is required to reduce exhaust temperature and emission of nitrogen oxide. The pressure difference between the exhaust side and the intake side is realized by a supercharger to obtain EGR. The high pressure difference requires high matching of the supercharger and is difficult to achieve. The control and measurement of EGR exhaust gas flow is realized by an EGR valve and a differential pressure flowmeter, and the pressure loss is large. The present application replaces the differential pressure flowmeter with the second temperature measurement member 41 and the third pressure measurement member 42 to reduce the pressure loss of EGR pipeline and compensate for the gas pressure through the diffuser section 63.

In some embodiments of the present disclosure, in order to fully mix the combustion gas and air, the combustion gas inlet 11 is provided on the housing 1, and the first mixing core 2 is provided with a plurality of first injection ports 22 along the circumferential direction, which are evenly spaced from each other. A second passage 73 is formed between the first mixing core 2 and the housing 1. The second passage 73 is annular. When the combustion gas enters the second passage 73, it passes through the first injection ports 22 and enters the first mixing core 2 to uniformly mix with the air entering from the air inlet.

In some embodiments of the present disclosure, an injection pipe 23 is further provided in the first mixing core 2, and an axial direction of the injection pipe 23 is the same as a radial direction of the first mixing core 2. Second injection ports 231 are evenly disposed on the injection pipe 23, wherein a part of the combustion gas enters the first mixing core 2 from the first injection ports 22, and another part of the combustion gas enters the first mixing core 2 from the second injection ports 231 to increase the incoming speed of the combustion gas.

The injection pipe 23 and the first mixing core 2 are connected by interference fit, and the number of the injection pipe 23 is not limited to one.

Another embodiment of the present disclosure also provides a natural gas engine, which includes the gas mixing device in any of the above embodiments.

The engine of the embodiment of the present disclosure has the same advantages as the gas mixing device in any of the above technical solutions, which will not be repeated herein.

The working principle of the gas mixing device will be briefly described below.

Air enters the first mixing core 2 from the air inlet, and the combustion gas enters the first mixing core 2 from the combustion gas inlet 11 through the first injection ports 22 and the second injection ports 231 and forms a mixed gas with air. The first-temperature measurement member and the first-pressure measurement member respectively measure the first temperature and the first pressure of the mixed gas. The mixed gas flows to the throat body 7. Due to the provision of the depressurization section 71 of the throat body 7, the flow velocity of the mixed gas increases, the pressure decreases and drops to the lowest in the first smooth section 72. The second-pressure measurement member 5 measures the second pressure of the mixed gas here, and the first flow rate of the mixed gas can be calculated from the measured temperature and a change in pressure. The flow rate of the combustion gas can be directly obtained from the engine demand or a flowmeter. The flow rate of air can be obtained from the difference between the first flow rate and the flow rate of combustion gas. The EGR exhaust gas enters the first passage 21 from the EGR exhaust gas inlet 12. The second-temperature measurement member 41 and the third-pressure measurement member 42 respectively measure the second temperature and the third pressure of the EGR exhaust gas. A negative pressure zone formed at the throat body 7 forces the EGR exhaust gas to enter the throat body 7, mix with the mixed gas, and then enter the intake manifold and cylinder head to burn and do work. The second pressure measurement member 5 measures the fourth pressure of the EGR exhaust gas here, and the second flow rate of the EGR exhaust gas can be calculated from the measured temperature and a change in pressure.

Described above are only specific preferred embodiments of the present disclosure, but the scope of protection of the present disclosure is not limited to this. Any change or replacement that can be easily contemplated by those skilled in the art within the technical scope disclosed in the present disclosure should be covered within the scope of protection of the present disclosure. Therefore, the scope of protection of the present disclosure shall be accorded with the scope of the claims.

The invention claimed is:

1. A gas mixing device, comprising:

a housing, which is provided with an air inlet, a combustion gas inlet, and an EGR exhaust gas inlet;

a first mixing core connected in the housing, wherein the air inlet and the combustion gas inlet respectively communicate with the first mixing core to form a mixed gas in the first mixing core;

a first measurement assembly, which is connected to the first mixing core and which is configured to obtain a first flow rate of the mixed gas and provide measurement data;

a second mixing core connected in the housing, wherein the EGR exhaust gas inlet and the first mixing core respectively communicate with the second mixing core; and a second measurement assembly, which is connected to the EGR exhaust gas inlet and which is configured to obtain a second flow rate of the EGR exhaust gas and provide measurement data.

2. The gas mixing device according to claim 1, further comprising a throat body connected in the housing, wherein the throat body is disposed between the first mixing core and the second mixing core, and a diameter of the throat body gradually decreases along a flow direction of gas to change gas pressures of the mixed gas and the EGR exhaust gas.

3. The gas mixing device according to claim 2, wherein the throat body comprises:

a depressurization section, wherein the depressurization section is connected in the housing, and a diameter of the depressurization section gradually decreases along the flow direction of the gas; and a first smooth section, wherein the first smooth section is connected to the depressurization section, and a diameter of the first smooth section is equal everywhere.

4. The gas mixing device according to claim 3, wherein the first measurement assembly comprises:

a first-temperature measurement member, which is connected to the housing and which is configured to measure a first temperature of the mixed gas; and a first-pressure measurement member, which is connected to the housing and which is configured to measure a first pressure of the mixed gas;

the gas mixing device further comprises a second-pressure measurement member, which is connected to the first smooth section and which is configured to measure a second pressure of the mixed gas after passing through the depressurization section.

5. The gas mixing device according to claim 4, wherein the second mixing core comprises a guide section, and a first passage is formed between the guide section and the first smooth section; and wherein a diameter of the guide section is larger than the diameter of the first smooth section, and the diameter of the guide section gradually decreases along the flow direction of the gas.

6. The gas mixing device according to claim 5, wherein the second measurement assembly comprises:

a second-temperature measurement member, which is connected to the EGR exhaust gas inlet and which is configured to measure a second temperature of the EGR exhaust gas; and a third-pressure measurement member, which is connected to the EGR exhaust gas inlet and which is configured to measure a third pressure of the EGR exhaust gas;

the second-pressure measurement member is further configured to measure a fourth pressure of the EGR exhaust gas after entering the first smooth section.

7. The gas mixing device according to claim 6, wherein the second mixing core further comprises:

a second smooth section, wherein the second smooth section is connected to the guide section, and a diameter of the second smooth section is equal everywhere; and a diffuser section, wherein the diffuser section is connected to the second smooth section, and a diameter of the diffuser section gradually increases along the flow direction of the gas.

8. The gas mixing device according to claim 1, wherein a second passage is formed between the first mixing core and the housing, the second passage is in communication with the combustion gas inlet, and the first mixing core is provided with a first injection port.

9. The gas mixing device according to claim 8, further comprising an injection pipe;

wherein the injection pipe is connected in the first mixing core, and the injection pipe is provided with a second injection port.

10. A natural gas engine, comprising the gas mixing device according to claim 1.

* * * * *